US011008152B2

(12) United States Patent
Lubbe et al.

(10) Patent No.: US 11,008,152 B2
(45) Date of Patent: May 18, 2021

(54) MULTI-CHAMBER CONTAINER

(71) Applicant: AMHIL ENTERPRISES, Mississauga (CA)

(72) Inventors: Pieter W. Lubbe, Mississauga (CA); Sumit Sharma, Brampton (CA); Hilario Gilbuena, Brampton (CA)

(73) Assignee: AMHIL ENTERPRISES, Mississauga (CA)

( * ) Notice: Subject to any disclaimer, the term of this patent is extended or adjusted under 35 U.S.C. 154(b) by 29 days.

(21) Appl. No.: 16/505,836

(22) Filed: Jul. 9, 2019

(65) Prior Publication Data

US 2020/0010257 A1 Jan. 9, 2020

Related U.S. Application Data

(60) Provisional application No. 62/695,321, filed on Jul. 9, 2018.

(51) Int. Cl.

| | |
|---|---|
| ***B65D 81/32*** | (2006.01) |
| ***B65D 43/02*** | (2006.01) |
| ***B65D 51/28*** | (2006.01) |

(52) U.S. Cl.

CPC ..... *B65D 81/3216* (2013.01); *B65D 43/0212* (2013.01); *B65D 51/28* (2013.01); *B65D 2543/00092* (2013.01); *B65D 2543/00231* (2013.01); *B65D 2543/00268* (2013.01); *B65D 2543/00296* (2013.01); *B65D 2543/00351* (2013.01)

(58) Field of Classification Search

CPC ..... B65D 51/28; B65D 81/3216; B65D 77/0446; B65D 77/0453; B65D 77/046; B65D 77/048; B65D 77/0486; B65D 77/0493; A47J 41/00

USPC ..... 220/592.23, 592.27, 521

See application file for complete search history.

(56) References Cited

U.S. PATENT DOCUMENTS

| | | | | |
|---|---|---|---|---|
| 3,070,275 | A * | 12/1962 | Bostrom | B65D 51/28 229/4.5 |
| 3,349,941 | A | 10/1967 | Wanderer | |
| 3,514,029 | A | 5/1970 | Powell | |
| 4,074,827 | A | 2/1978 | Labe | |
| 4,340,138 | A | 7/1982 | Bernhardt | |
| 4,348,421 | A * | 9/1982 | Sakakibara | A47J 47/14 206/217 |
| 5,035,320 | A | 7/1991 | Plone | |
| 5,046,632 | A | 9/1991 | Bordner | |

(Continued)

*Primary Examiner* — Jeffrey R Allen

(74) *Attorney, Agent, or Firm* — Jeffrey S. Melcher; Melcher Patent Law PLLC

(57) ABSTRACT

A multi-chamber container is provided having a main container and a main lid. The main container is configured to receive a first inner container which rests on the rim section of the main container. An optional cover for the first inner container is typically provided. A second inner container is releasably attached to, and held to, the lower surface of the main lid by an inner attachment section. The main container is sealed by a skirt section on the main lid so that the contents within the main container, the first inner container, and the second inner container, are only accessible when the lid has been detached from the container, and the first and second containers have been removed. A low cost, easily assembled, secure, single-use, multi-chamber container is provided.

17 Claims, 3 Drawing Sheets

(56) References Cited

U.S. PATENT DOCUMENTS

| | | | | |
|---|---|---|---|---|
| 5,678,720 | A | 10/1997 | Van Melle | |
| 6,164,485 | A | 12/2000 | Hilton | |
| D643,284 | S | 8/2011 | Zomorodi | |
| D643,286 | S | 8/2011 | Zomorodi | |
| 8,596,491 | B2 | 12/2013 | Buck | |
| 9,038,845 | B1 | 5/2015 | Buck | |
| 2004/0035867 | A1 | 2/2004 | Schultz | |
| 2005/0194383 | A1* | 9/2005 | House | B65D 51/28 220/23.86 |
| 2007/0172554 | A1* | 7/2007 | Blythe | B65D 43/0204 426/106 |
| 2012/0138608 | A1 | 6/2012 | Rusnak | |
| 2013/0068772 | A1* | 3/2013 | Durdon | B65D 51/28 220/521 |

* cited by examiner

MULTI-CHAMBER CONTAINER

FIELD OF THE INVENTION

This invention relates to containers and container lids, and in particular, containers with lids, having a plurality of separated and detachable compartments or chambers, associated therewith.

BACKGROUND OF THE INVENTION

A common intended usage of container and their associated container lids, that are in keeping with the present invention, is to provide a container and container lid associated therewith, lid which facilitates the addition of a plurality of additive materials, such as fresh fruits, nuts, granola, cheese, sauces, condiments, garnishes, and the like, to a primary material, such as ice cream, yogurt, cottage cheese and the like, but which is kept separated from the primary materials until such time as the combined material is to be consumed. This achieves several advantages, including precluding the transference of moisture from the various materials to each other, which maintains the crispness of the materials, and thus assuring the requisite mouth sense of the additive to the primary material immediately upon its consumption. This approach also allows the user to select the desired amount of additive material to be primary material.

One example of these types of containers, is one wherein a container of a salad dressing, is included into a compartment, and then securement of the compartment to a lid which will then be placed over a salad. This assures freshness of the salad and precludes soaking in of the salad dressing into the salad greens.

Still further, persons who may purchase a beverage such as coffee may very often carry the beverage away from the coffee shop for later consumption, such as in the office or even at home. However, some people prefer to add condiments such is cream or sugar to the coffee immediately prior to consuming the same. Lids in keeping with the present invention permit such a step because the cream or milk, sweetener, or both, can be placed into the compartment which is associated with the lid and is then secured in place within the interior region of the lid. Upon arrival at the place where the beverage will be consumed, the lid will be removed from the cup and the compartment will be released from its securement within the lid so as to permit addition of the condiments contained therein to the beverage.

Yet another more specialized usage of container lids in keeping with the present invention may be found in entertainment venues such as theatres, fairgrounds, and the like. Here, some vendors may be may be selling a beverage or other food item, in particular, with which a prize or token of some sort is included. Only after purchase of the beverage or food item will the prize or token be revealed by removing the lid from the beverage or food item and then removing the compartment which contains the prize or token from the interior region of the lid.

It follows that in many circumstances such as those described above, it may be appropriate to provide assurance that the contents of the container, or of the compartment within the lid, have not been tampered with. This may easily be achieved by such as placing an adhesive tape around the skirt of the lid, shrink fitting a tape or frangible ribbon around the skirt of lid, or other means well known to those skilled in the art.

Thus, as will be seen hereunder, the present invention solves a pressing need which has heretofore presented itself to a variety of business concerns, mostly food and beverage related, and that is the provision of a product which is to be accompanied by another product of some sort which must remain separated until such time as consumption, whereupon the contents of the detachable compartment which forms part of the lid assembly may be recovered and added to the first packaged product; or in some cases, as noted above, where a prize or token is found in the compartment, that prize or token will be pocketed or returned for reward. Accordingly, beverages will remain as originally dispensed until such time as a condiment or other additive is mixed into the primary material, whether it is a beverage, fresh yogurt or cottage cheese, salads, or the like, and remains fresh, and the additive material, such as fruit or nuts, condiments, salad dressings or the like, maintain their original state, again until such time as they are added to primary material.

DESCRIPTION OF THE PRIOR ART

Bostrom, in U.S. Pat. No. 3,070,275, describes a reusable container whose purpose is to provide a plurality of areas or chambers for receiving and packaging separated foodstuffs. The container includes a cup-shaped tub which is placed into a conventional tub and which is constructed to receive the foodstuffs that may be separated from the other foodstuff. A cover is provided for the cup-shaped tub, and that cover thus defines a compartment for receiving the other foodstuff which is to be separated from the foodstuff which is contained in the conventional tub. The entire structure is intended to be reusable, and includes at least three different areas in which the containers are attached one to the other.

U.S. Pat. No. 3,349,941, issued to Wanderer, teaches a compartmented container package which is intended for packaging different foodstuffs or other products in the same container, but in different compartments. However, in this approach, multiple containers are sealed by use of a compression fitting over the upper rim of the main container.

Powell, in U.S. Pat. No. 3,514,029, relates to a compartmented communion container wherein the bread and wine intended for consumption during the celebration of communion are separated one from the other so that the wine is held in a cup-like lower element with an intermediate element which is frictionally secured to the lower element and into which the bread is placed, and the intermediate element has an upper element or cover bonded to it. A multi-purpose closure for containers is described in U.S. Pat. No. 4,074,827, to Labe, wherein there is a base member which has a cover member releasably secured thereto by their respective flanges. When assembled to a suitable container such as a beverage cup, the central portion of the cover member is disposed over the central portion of the base member and is spaced therefrom so as to form an enclosed space or cavity. That cavity serves as an enclosure for product; examples of which are sugar, cream, lemon, or a premium such as a coupon, coin, jewelry, or advertising material or a puzzle or game. A further provision is made by such as a cross-cut so as to enable a straw to be extended therethrough into the container. However, at least two different covers are seated over and around the upper rim of the main container.

Another multiple compartment multiple seal container is taught in U.S. Pat. No. 4,340,138, to Bernhardt. This device comprises a first container formed of a polymeric material, and a second container which nests into the first container. A lid member has a skirt which extends into the second container and provides a seal therefor. Then, a membrane such as cellophane is disposed in registry with the first container and is sealed to the lid and to the first container, and optionally also to the second container, so as to provide a composite package which includes discrete compartments having multiple seals.

U.S. Pat. No. 5,035,320 to Plone, describes a dispenser system that has an elongated selectively activatable dispensing pusher. The length of the pusher, and its placement, determine how much of an additive will be dispensed into a cup to which the dispenser system has been affixed.

Bordner, in U.S. Pat. No. 5,046,632 describes a closure assembly for a fibre container which includes a moulded lid with multi-mode closure orientations. Here, primary latching components within the skirt assembly of the lid are removable from the lid through the use of a pull tab and parting groove architecture. After the container has been filled, the lid may be attached thereto in a filled mode so that a primary latching feature is engaged by proper orientation of the lid, thus allowing the user to remove a primary latching feature in a tear-away fashion but so that the secondary latching feature remains in the skirt assembly so as to permit re-closure of the container.

U.S. Pat. No. 5,678,720 to Van Melle, teaches a single disposable dome lid which may be used with disposable containers having differing sizes. The teachings are particularly directed to the placement of the waist and skirt portions of the disposable lid, which are axially aligned so that the lid may be placed over a larger or smaller diameter container.

Hilton, in U.S. Pat. No. 6,164,485, describes a container lid which has a base with a rim which is adapted to fit onto a container, a section which projects above the rim and which includes an inverted recess, and a domed cover which is attached to the raised section above the recess so as to create a compartment within the inverted recess and having substantially the same depth as the container lid. Releasable sealing means is provided between the cover and the raised section so as to provide access to the compartment. Thus, the user is required to detach the cover so as to reveal the contents of the compartment, and to remove the base so as to obtain access to the contents of the container.

Durdon et al., in U.S. Patent Publication No. 20130068772 describe a disposable, single-use container system in which a small container is fitted underneath the domed lid of a larger container. Rusnak et al. in U.S. 20120138608, and Schultz et al. in U.S. 20040035867, provide similar products which are intended for reuse in multiple applications. All of these products merely provide a container which is attached to, and substantially sealed to the lid of the main container. Thus, they only provide a main container space, and a secondary space located within the container lid.

Similar designs are shown in U.S. design Pat. Nos. D643,284 and D643,286, to Zomorodi et al., in which a parfait cup is shown having an inner container. However, these designs only provide one inner container, and they require multiple lids to be attached and sealed to the rim of the main container.

Other approaches to multiple containers are shown by Buck, in U.S. Pat. Nos. 8,596,491 and 9,038,845.

While these various lids and containers have provided some utility in this area, it would be desirable to provide a lid and container combination that provided improved flexibility of use, while providing desirable security features. Accordingly, it would be advantageous to provide an improved multi-chamber container over those described in the prior art. Specifically, it would be advantageous to provide a multi-chamber container in which the various chambers could be prefilled individually, and in which the individual container sections could be used or omitted, depending on the user's specific application. It would also be advantageous to provide a multi-chamber container in which use of the various container inside of the multi-chamber container, had minimal impact on the rim closure for the lid of the main container.

SUMMARY OF THE INVENTION

Accordingly, it is a principal advantage of the present invention to provide a multi-chamber container which provides improved security features.

It is a further advantage of the present invention to provide a multi-chamber container in which the various containers used in the multi-chamber container can be individually and separately filled.

It is a still further advantage of the present invention to provide a multi-chamber container which provides the flexibility to use or omit the use of various individual containers within the multi-chamber container, depending on the needs of the user.

It is an even still further advantage of the present invention to provide a multi-chamber container which provides minimal impact on the rim closure for the main container.

The advantages set out hereinabove, as well as other objects and goals inherent thereto, are at least partially or fully provided by the multi-chamber container of the present invention, as set out herein below.

Accordingly, in one aspect, the present invention provides a multi-chamber container comprising:

a main container having an upper, essentially level rim peripherally located at the top of a side wall of the main container;

a first inner container having a first essentially flat rim section configured to rest on the level rim of the main container;

optionally, a first cover having an essentially flat edge surface around the peripheral edge of the first cover, which essentially flat edge surface is configured to rest on the first essentially flat rim section of the first container;

a main lid having a lower skirt section around a lower peripheral edge of said lid, wherein said lower skirt section is configured to releasably attach the main lid to the main container by attachment of the skirt section of the main lid to the essentially level rim section of the main container;

an inner attachment section on a lower surface of the main lid, which inner attachment section is located radially inward of the lower skirt section of the main lid; and a second inner container having a essentially level second inner rim section which second inner rim section is configured to be attached to the inner attachment section of the main lid.

In a preferred embodiment, the multi-chamber container consists of all of these elements, and as such, the present invention preferably provides a multi-chamber container consisting of:

a main container having an upper, essentially level rim peripherally located at the top of a side wall of the main container;

a first inner container having a first essentially flat rim section configured to rest on the level rim of the main container;

a first cover having an essentially flat edge surface around the peripheral edge of the first cover, which essentially flat edge surface is configured to rest on the first essentially flat rim section of the first container;

a main lid having a lower skirt section around a lower peripheral edge of said lid, wherein said lower skirt section is configured to releasably attach the main lid to the main container by attachment of the skirt section of the main lid to the essentially level rim section of the main container;

an inner attachment section on a lower surface of the main lid, which inner attachment section is located radially inward of the lower skirt section of the main lid; and a second inner container having a essentially level second inner rim section which second inner rim section is configured to be attached to the inner attachment section of the main lid.

DETAILED DESCRIPTION OF THE INVENTION

Generally speaking, the main container is preferably a circular cup shaped container having a generally level, annular rim section. However, other shapes are not excluded.

In this specification, the term "level" is used to denote a rim which is essentially formed within a single plane.

Preferably, both the first and second inner container are also cup shaped, and also have annular rim sections. The first and second containers are also sized and shaped so as to fit within the size and shape of the main container, and/or the main container lid, as necessary in the practice of the present invention.

The first inner container is thus preferably a cup-shaped container having a circular, flat and level, peripheral rim section, in the upper area of the first inner container. In use, the peripheral rim section of the first inner container rests on the rim section of the main container, and thus, the first inner container is preferably held in position within an upper area, or "volume", of the main container.

While the first inner container can be left uncovered, preferably, a first cover is provided to hold the contents of the first container within the first container, until the first cover is removed. The essentially flat edge surface of the first cover is preferably configured to rest on the first essentially flat rim section of the first inner container, and thereby acts to releasably close the first inner container. The first cover may also comprise an inner shoulder section which extends downward from the flat edge surface, whereby the inner shoulder is sized and shaped so as to form a friction-fitted seal with the inner surface of an inner wall of the first container. This inner shoulder thereby aids in releasably closing the first inner container.

Preferably, the flat peripheral rim section of the first inner container, and the essentially flat edge surface of the first cover are thin and level, so as to provide minimal interference with the attachment of the lower skirt section of the main lid to the essentially level rim around the peripheral edge of the main container. In this specification, the term "thin" is meant to indicate that the affected sections are preferably no thicker than the materials used to produce the first inner container and/or the first cover. Typically, these are less than or equal to about 1 mm in thickness, and more preferably, less than or equal to about 0.5 mm in thickness, and even more preferably less than or equal to about 0.3 mm in thickness. Typically, the thickness is between 0.2 and 0.3 mm.

Also, the term "about" in this specification is preferably meant to be interpreted as being at the stated value, plus or minus 20%.

The second inner container is also preferably a cup-shaped container having a circular, level, peripheral rim section, in the upper area of the second inner container. In use, the peripheral rim section of the second inner container is configured to be attached to the main lid, as will be described hereinbelow. The second inner container is preferably held in position within the area, or volume, defined by the main lid.

The main lid is preferably a dome lid which is constructed so that the lid extends above its lower skirt section, and the lower skirt section of the main lid is configured to be releasably friction fitted to the rim of the main container. The main lid preferably seals the main container. It will be noted that when the main lid is placed onto the main container, the first inner container is effectively sealed, and held securely in place within the main container. It will also be noted that any contents held within the first inner container are inaccessible to the user, without first removing the main lid.

The main lid also includes an inner attachment section, which is preferably formed by way of a waist portion formed in the main lid, at a point which is radially inward of the skirt section. This waist portion is configured to releasably receive the essentially level inner rim section of the second inner container in a manner that the second container is attached to the main lid.

The inner attachment section for use in releasably attaching the second inner container with the main lid, is preferably formed by a recessed area formed in the main lid in the upper region thereof, and this recess is dimensioned so as to secure the rim of the second inner container, therein. The rim of the second container is then held in the main lid until either the second container and/or the main lid is momentarily deformed.

As a result, when the second inner container is attached to the main lid, the main lid also effectively seals the second inner container.

In this arrangement, the second compartment is contained within the main lid, and the second container is inaccessible until the main lid is removed from the main container. As such, the contents of the second container are also inaccessible when the main lid is connected to the main container.

Accordingly, it can be noted that in the preferred configuration, the contents within the first container and the second container, are securely held within the respective containers, and that access to the contents of the main container, the first container, and the second container, are only accessible when the main lid has been detached from the main container.

As a result, the entire multi-chamber container can be sealed to avoid tampering, and the like, using a simple container seal around the connection between the main lid and the main container. This container sealing can be achieved by, for example, application of an adhesive tape or ribbon, or by applying a shrink-wrapped seal around the connection between the main container and the main lid. Thus, the user can be assured that the contents of the main container, the first container and the second container have not been tampered with, prior to removing the main lid from the main container.

The main container, main lid, inner containers, cover, and the like, are produced from any suitable materials, including plastics or paper, or the like. For most applications, the multi-chamber containers of the present application are intended to be single-use products which are made of materials that can be recycled. These materials can be clear, opaque, transparent, translucent, or the like, and combinations of various materials can be considered. Those skilled in the art will be well aware of the nature of suitable materials for the intended applications, but plastic materials such as polyethylene, polypropylene, polystyrene, polyvinyl chloride, polylactic acid (PLA), and the like, are preferred.

A most preferred plastic material is clear polyethylene terephthalate (PET). Combinations of various types of plastics can also be used with various components manufactured from the same, or different materials.

Moreover, the various components, when made of plastic materials, can be manufactured using any suitable fabrication method, including injection moulding, or the like. Most preferably, however, the various components are formed by blow moulding, pressure forming, vacuum forming, thermoforming, etc., or by similar techniques. In a preferred embodiment, all of the components of the multi-chamber container of the present invention, are made of the same plastic material, and all are preferably produced by thermoforming. In a most preferred approach, most or all of the components of the multi-chamber container of the present invention are clear, thermoformed, PET components.

The size and volume of the various components used in the multi-chamber container of the present invention can be varied depending on the specific needs of the user. In particular, for a given main container size, the size and volumes of the first and section containers can change to allow the user to vary the relative size of the volume available in the main container, the first container and the second container.

Preferably, the first container is sized and shaped so that it is positioned solely within the volume of the main container. However, the position of the first essentially flat rim section can be moved downwards on an outer wall of the first container, so that at least a portion of the first container is raised out of the volume of the main container, and thus, moved within the volume of the main lid.

The size and shape of the second container can also be varied. Preferably, however, the second container has a shape and size so that it is completely held within the volume of the main lid. As such, preferably, a bottom surface of the second container is located at a position above, or in the same general region as the lower skirt section of the main lid. The bottom surface of the second container preferably does not contact the first cover on the first container. However, contact between the first cover, and the bottom surface of the second container, is not excluded.

Different sized and shaped first and second containers can also be provided to a user for a selected main container size or shape. This permits the user to have some flexibility in selecting the most appropriate container sizes for their specific applications.

It can be further noted, that the present arrangement also permits the users to omit the first and/or second inner containers, depending on the needs of the user. This permits the user to have some flexibility in deciding whether one or two additional containers are to be used, or even decide if any additional inner containers are necessary for use in combination with the main container.

BRIEF DESCRIPTION OF THE DRAWINGS

The novel features which are believed to be characteristic of the present invention, as to its structure, organization, use and method of operation, together with further objectives and advantages thereof, will be better understood from the following drawings in which a presently preferred embodiment of the invention will now be illustrated by way of example. It is expressly understood, however, that the drawings are for the purpose of illustration and description only and are not intended as a definition of the limits of the invention.

In particular, embodiments of this invention will now be described by way of example in association with the accompanying drawings in which.

DETAILED DESCRIPTION OF THE PREFERRED EMBODIMENTS

Figure 1:
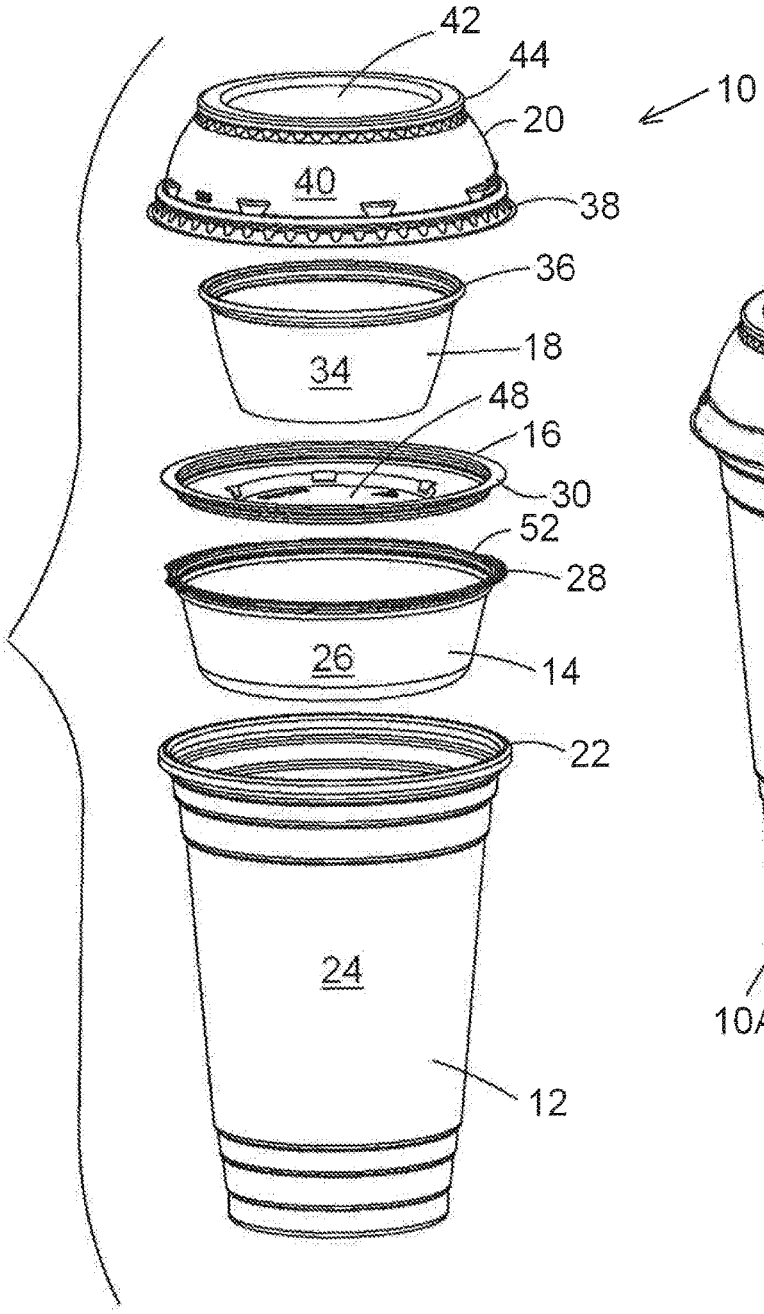
FIG. 1 is an exploded perspective view of the multi-chamber container system of the present invention.

The novel features which are believed to be characteristic of the present invention, as to its structure, organization, use and method of operation, together with further objectives and advantages thereof, will be better understood from the following drawings and discussion in which a presently preferred embodiment of the present invention will now be illustrated by way of example only. In the drawings, it will be noted that like reference numerals depict like elements.

It is expressly understood, however, that the drawings are for the purpose of illustration and description only and are not intended as a definition of the limits of the invention. Also, unless otherwise specifically noted, it should be assumed that all of the features described herein may be combined with any of the above aspects, in any combination.

Figure 2:
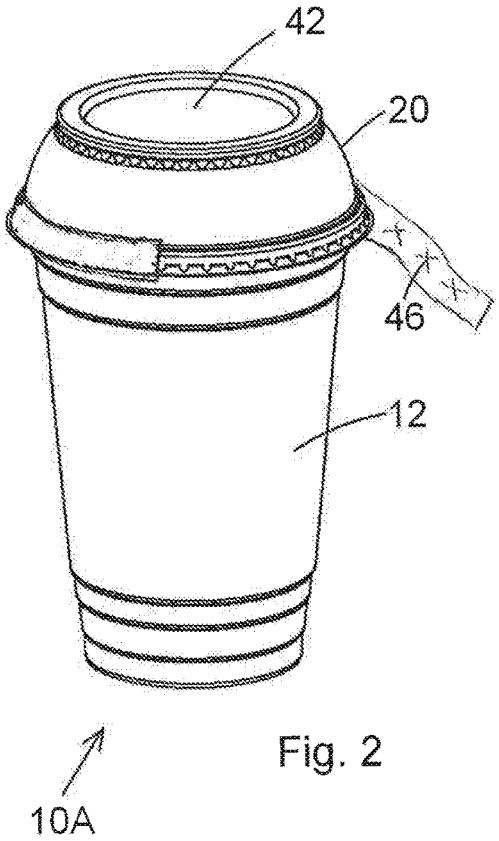
FIG. 2 is a perspective view of the assembled container system of FIG. 1.

An exploded perspective view of the multi-chamber container 10 of the present invention is shown in FIG. 1. The assembled container 10A is shown in FIG. 2. As seen in FIG. 1, the various components of container 10 include a main container 12, a first inner container 14, a first cover 16, a second inner container 18 and a main lid 20. All of these components are manufactured by thermoforming of an opaque, resilient plastic, such as PET or polypropylene.

As illustrated, main container 12 has a drinking-cup shape and size, but those skilled in the container lid art will understand that the container 12 may have any suitable size and configuration that might be desired. Typically, main container 12 will hold between 300 and 2000 ml, but larger or smaller volumes are also possible. At the top of main container 12 is an essentially level, annular circular rim 22 established around a peripheral edge of main container 12, at the top of a side wall 24. Rim 22 could be a flange, but is generally included, as shown in the figures, as a rolled portion of the upper end of wall 24.

First inner container 14 has a cup-shaped design, as illustrated, and includes a side wall 26 and an annular, flat, level rim section 28 at the top of wall 26. First inner container 14 has a suitable shape and size so that rim section 28 lies flat on rim 22 of main container 12. Typically, the first inner container 14 will hold a volume of between 100 and 300 ml, but other volumes, that fit within main container 12, are possible. First inner container 14 also includes optional recesses 52 in rim section 28. These recesses 52 allow first cover 16 to be more easily removed from first inner container 14.

Figure 3:
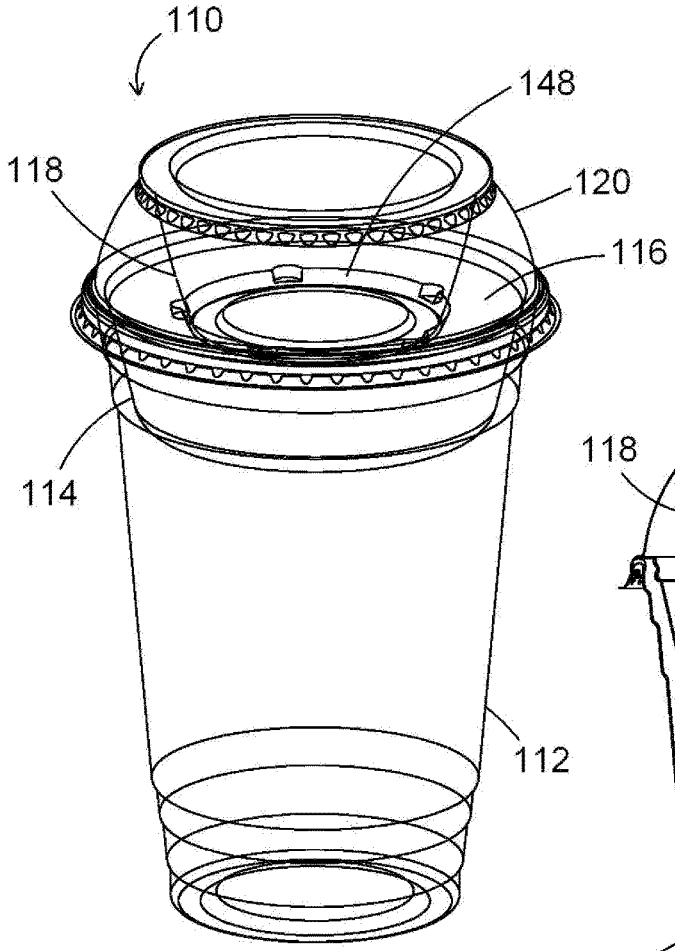
FIG. 3 is a perspective view of a first variant of the assembled container shown in FIG. 2.
Figure 4:
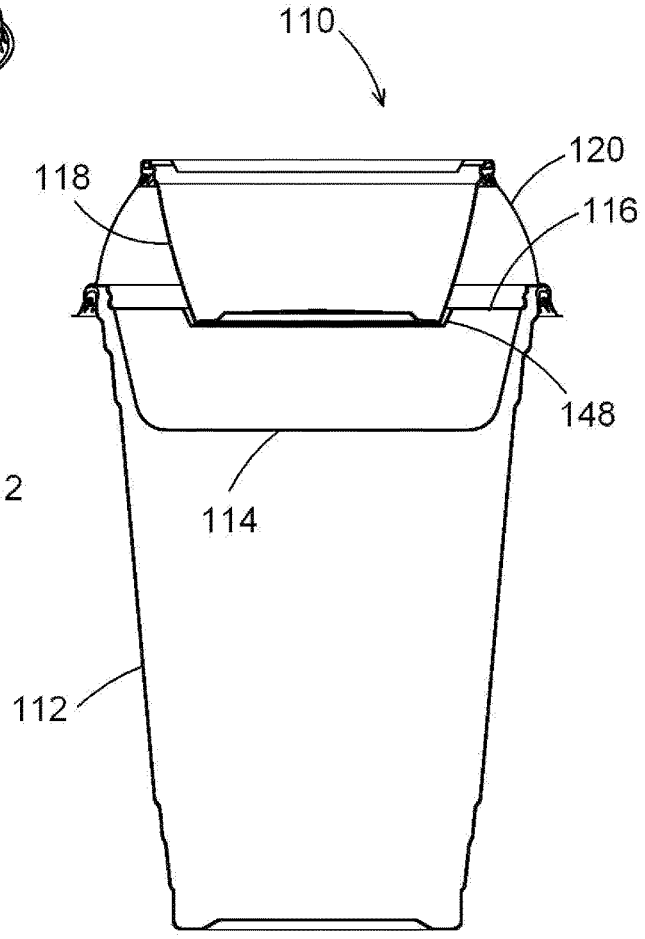
FIG. 4 is a side view of the assembled container shown in FIG. 3.

First cover 16 is optional, but is shown in FIGS. 1, 3 and 4. Cover 16 includes an annular, flat edge surface 30 which rests on rim section 28 of first inner container 14. First cover 16 also includes an annular undercut, shoulder section 32 which is configured to snap on to, and rest against an inner portion of wall 26, and acts to aid in sealing first container 14. An inner well 48 is preferably provided on first cover 16, and the bottom of second inner container 18, fits within well 48.

Figure 6:
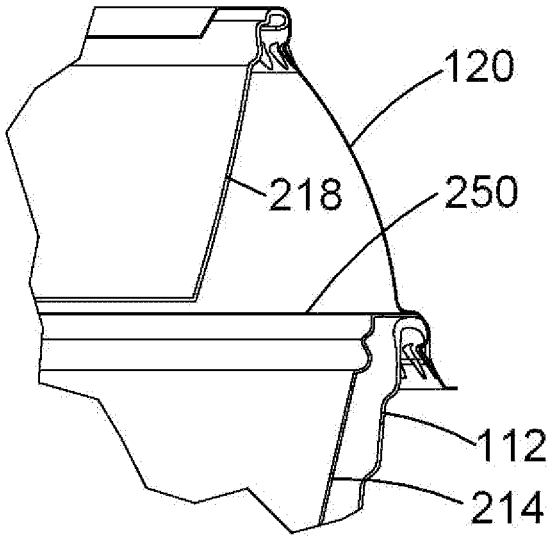
FIG. 6 is a cross-sectional partial view of an alternative embodiment of the first container in a multi-chamber container of the present invention.

Cover 16 can be omitted. Alternatively however, the first cover can be, for example, some other product for closing of first inner container 14. These products could include, for example, an adhesive sealing film 250, as seen in FIG. 6, as discussed hereinbelow.

Second inner container 18 is again cup-shaped, as illustrated, and includes side wall 34 having an annular, level, rolled edge rim section 36 at the top of wall 34. Second container 18 typically has a volume of from 30 to 150 ml, but other volumes are possible.

Main lid 20 preferably has a dome shape, as illustrated in FIG. 1, and includes an annular skirt section 38, a side wall 40, and a top section 42. Main lid 20 typically has a volume of between 100 and 300 ml, but other volumes are possible. Preferably, main lid 20 is sized so as to house most, or all, of second container 18 within the volume of main lid 20. However, the second inner container 16 can extend below main lid 20, and be positioned within well 48 of first cover 16, or within first inner container 14.

Main lid 20 also includes an annular recessed waist portion 44 at the top of side wall 40, which is positioned so as to be radially inside of annular skirt section 38. Because of the resilient nature of the plastic materials used in construction of container 10, waist portion 44 can be twisted to accept and hold, the annular rim section 36 of second inner container 18. In this manner, inner container 18 is held in position, inside of main lid 20.

Figure 5:
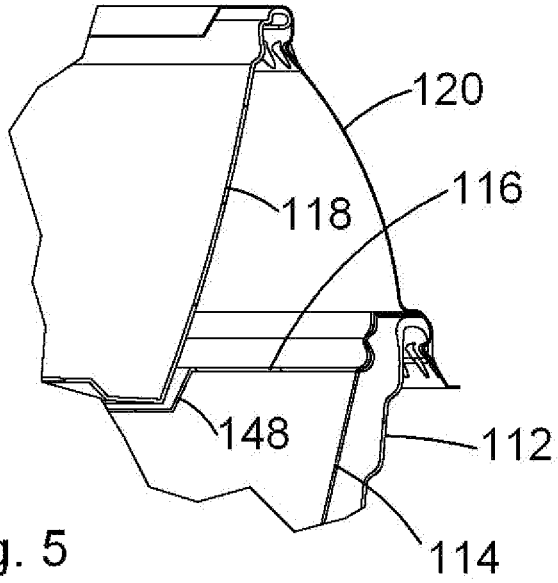
FIG. 5 is a cross-sectional partial view of the assembled container system of FIG. 2.

The precise nature of skirt section 38 can vary, but generally can be any known type of system for attaching disposable lids to the rolled edge of a cup-shaped container. However, one preferred approach for the skirt design is illustrated in FIG. 5, discussed hereinbelow.

When assembled together, as shown in FIG. 2, container 10 is sealed closed when main lid 20 is attached to main container 12, by using skirt section 38. First inner container 14 are held in place within container 10, since skirt section 38 rests on top of level rim section 28. Second inner container 18 is held in place within container 10 since its rim section 36 is held within recessed waist portion 44, and optionally, within well 48 in first cover 16.

It will be observed that when main container 12 is sealed by skirt section 38 on main lid 20, the contents within the main container 12, the first inner container 14, and the second inner container 16, are only accessible when main lid 20 has been detached from the container, and the first and second inner containers (14 and 16) have been removed.

In addition, main lid 20 can be sealed to main container 12 using, for example, an adhesive tape 46, which is shown as being partially installed, in FIG. 2. To gain access to any of the contents of the main container, or the first or second inner container, the user must first remove adhesive tape 46, in order to be able to remove main lid 20 from main container 12.

In FIG. 3, a modified container 110 is shown, wherein all of the components, are the same as for FIG. 1, but in this variant, all of the various components are made of a clear resilient PET plastic. This includes a clear main container 112, a clear first inner container 114, a clear first cover 116, a clear second inner container 118 and a clear main lid 120.

A side view of container 110 is shown in FIG. 4.

From FIGS. 3 and 4, the arrangement of the various components can be more easily seen, and it will be observed that first container 114 is held within the volume of main container 112. Additionally, it can be seen that second container 118 is held mostly within the volume of main lid 120, but does extend downward into main container 112, and thereby rests within well 148 in first cover 116.

In FIG. 5, an enlarged partial view of the components around main lid 120 are shown. Additional details on the construction and assembly of container 110 are provided. In particular, the preferred undercut nature of the attachment mechanism for attaching the lid 120 to main container 112, is shown.

In FIG. 6, a further variant of the container of the present invention is shown having main lid 120, and main container 112. In this embodiment, a modified second inner container 218 is used, which second inner container is held completely within the volume of main lid 120.

Modified first inner container 214 is also used in this embodiment which is essentially the same of first inner container 114. However, in FIG. 6, first inner container 214 has been sealed with an adhesive foil 250. Foil 250 covers the opening at the top of first inner container 214, and can be punctured or peeled off of first inner container 214, prior to use.

It will be clear from these figures, that a low cost, easily assembled, secure, single-use, multi-chamber container is provided by the present invention.

Thus, it is apparent that there has been provided, in accordance with the present invention, a multi-chamber container which fully satisfies the goals, objects, and advantages set forth hereinbefore. Therefore, having described specific embodiments of the present invention, it will be understood that alternatives, modifications and variations thereof may be suggested to those skilled in the art, and that it is intended that the present specification embrace all such alternatives, modifications and variations as fall within the scope of the appended claims.

Additionally, for clarity and unless otherwise stated, the word "comprise" and variations of the word such as "comprising" and "comprises", when used in the description and claims of the present specification, is not intended to exclude other additives, components, integers or steps. Further, the invention illustratively disclosed herein suitably may be practiced in the absence of any element which is not specifically disclosed herein.

Moreover, the words "substantially" or "essentially", when used with an adjective or adverb is intended to enhance the scope of the particular characteristic; e.g., substantially planar is intended to mean planar, nearly planar and/or exhibiting characteristics associated with a planar element.

Further, use of the terms "he", "him", or "his", is not intended to be specifically directed to persons of the masculine gender, and could easily be read as "she", "her", or "hers", respectively.

Also, while this discussion has addressed prior art known to the inventor, it is not an admission that all art discussed is citable against the present application.

What is claimed is:

1. A multi-chamber container comprising:

a main container having an upper, essentially level rim peripherally located at the top of a side wall of the main container;

a first inner container having a first essentially flat rim section configured to rest on the level rim of the main container;

a main lid having a lower skirt section around a lower peripheral edge of said lid, wherein said lower skirt section is configured to releasably attach the main lid to the main container by attachment of the skirt section of the main lid to the essentially level rim section of the main container;

an inner attachment section on a lower surface of the main lid, which inner attachment section is located radially inward of the lower skirt section of the main lid;

a second inner container having a essentially level second inner rim section which second inner rim section is configured to be attached to the inner attachment section of the main lid; and a first cover having an essentially flat edge surface around a peripheral edge of the first cover, and wherein said essentially flat edge surface is configured to rest on the first essentially flat rim section of the first container.

2. The multi-chamber container of claim 1 wherein the main container is a circular cup-shaped container having a level, annular rim section, and said first inner container is a circular cup-shaped container having an annular first rim section.

3. The multi-chamber container of claim 2 wherein the first rim section on the first inner container rests on the level, annular rim section of the main container.

4. The multi-chamber container claimed in claim 1 wherein said main container and said first container are circular, cup-shaped containers, and wherein said first cover is an essentially flat, circular cover having an annular, flat edge surface.

5. The multi-chamber container of claim 4 wherein said first cover includes an inner shoulder section which extends downward from the flat edge surface, and is sized and shaped so as to form a friction-fitted seal with an inner surface of an inner wall of the first inner container.

6. The multi-chamber container of claim 1 wherein said first cover is a film attached to said flat edge surface of said first inner container.

7. The multi-chamber container of claim 1 wherein said main lid is dome shaped having a circular lower skirt section for attachment to the essentially level rim of the main container, and a circular inner attachment section which is located radially inward of said skirt section.

8. The multi-chamber container of claim 7 wherein said second container is a circular, cup-shaped container having an annular second inner rim section, which second inner rim section is configured to be attached to the circular inner attachment section of said main lid.

9. The multi-chamber container of claim 8 wherein said second inner container is held within the area, or volume, defined by the main lid.

10. The multi-chamber container of claim 7 where said inner attachment section is formed by way of a waist portion formed in the main lid above the skirt section and at a point which is radially inward of the skirt section.

11. The multi-chamber container of claim 10 wherein said waist portion is configured to releasably receive the essentially level inner rim section of the second inner container.

12. The multi-chamber container of claim 1 wherein said multi-chamber container is sealed using a container seal around the connection between the main lid and the main container.

13. The multi-chamber container of claim 12 wherein the container seal is achieved provided by application of an adhesive tape or ribbon, or by applying a shrink-wrapped seal, around the connection between the main container and the main lid.

14. The multi-chamber container of claim 1 wherein the main container, main lid, and first and second inner containers, are produced from single-use products which are made of materials that can be recycled.

15. The multi-chamber container of claim 14 wherein said single-use products are plastics or paper.

16. The multi-chamber container of claim 15 wherein said plastic is polyethylene terephthalate (PET) or polypropylene, or combinations thereof.

17. A multi-chamber container consisting of:

a main container having an upper, essentially level rim peripherally located at the top of a side wall of the main container;

a first inner container having a first essentially flat rim section configured to rest on the level rim of the main container;

a first cover having an essentially flat edge surface around the peripheral edge of the first cover, which essentially flat edge surface is configured to rest on the first essentially flat rim section of the first container;

a main lid having a lower skirt section around a lower peripheral edge of said lid, wherein said lower skirt section is configured to releasably attach the main lid to the main container by attachment of the skirt section of the main lid to the essentially level rim section of the main container;

an inner attachment section on a lower surface of the main lid, which inner attachment section is located radially inward of the lower skirt section of the main lid; and a second inner container having a essentially level second inner rim section which second inner rim section is configured to be attached to the inner attachment section of the main lid.

* * * * *